US005620156A

United States Patent [19]

Berggren et al.

[11] Patent Number: 5,620,156

[45] Date of Patent: Apr. 15, 1997

[54] DEVICE FOR OPERATING A SWITCH FOR RAIL POINTS

[75] Inventors: Clarence Berggren, Saltsjö-Bro; Lars Eklund, Vällingby; Uno Norrgård, Sorunda, all of Sweden

[73] Assignee: ABB Signal AB, Stockholm, Sweden

[21] Appl. No.: 549,756

[22] PCT Filed: May 27, 1994

[86] PCT No.: PCT/SE94/00502

§ 371 Date: Nov. 24, 1995

§ 102(e) Date: Nov. 24, 1995

[87] PCT Pub. No.: WO94/27853

PCT Pub. Date: Dec. 8, 1994

[30] Foreign Application Priority Data

May 27, 1993 [SE] Sweden ..... 9301801

[51] Int. Cl.[6] ..... B61L 5/00

[52] U.S. Cl. ..... 246/221; 246/225; 246/448; 246/452

[58] Field of Search ..... 246/131, 136, 246/137, 138, 147, 151, 158, 218, 220, 221; 262, 263, 382, 401, 435 R, 448, 449, 450, 451, 452, 476, 225

[56] References Cited

U.S. PATENT DOCUMENTS

| | | | |
|---|---|---|---|
| 4,093,163 | 6/1978 | Larsson . | |
| 4,860,978 | 8/1989 | Durchschlag et al. . | |
| 4,896,850 | 1/1990 | Carmes | 246/476 |
| 4,921,189 | 5/1990 | Callegari | 246/401 |
| 5,192,038 | 3/1993 | Ocampo | 246/476 |
| 5,292,091 | 3/1994 | Callegari et al. | 246/448 |

FOREIGN PATENT DOCUMENTS

| | | | |
|---|---|---|---|
| 320636 | 6/1989 | European Pat. Off. | 246/448 |
| 467865 | 1/1992 | European Pat. Off. | 246/262 |
| 614467 | 5/1935 | Germany . | |
| 1755105 | 7/1974 | Germany . | |
| 3543403 | 8/1988 | Germany . | |

*Primary Examiner*—Mark T. Le
*Attorney, Agent, or Firm*—Pollock, Vande Sande & Priddy

[57] ABSTRACT

A device for operating a switch of a railway track including switch blades. The device includes a drive module, a linear operating module coupled to and driven by the drive module for generating a linear movement and at least one locking module interconnected between the linear operating module and the switch blades. The locking module transfers the linear movement from the linear operating module to the switch blades, thereby moving the switch blades across a longitudinal direction of the railway track from a first position to a second position. The at least one locking module also locks the switch blades in the first position or the second position independently of the linear operating module. A girder box forms a sleeper of the railway track for housing the drive module, the linear operating module, and the at least one locking module. The device also includes apparatus for joining the drive module, the linear operating module, and the at least one locking module. The joining apparatus permits independent replacement of the drive module, the linear operating module, and the at least one locking module. The drive module, the linear operating module, and the at least one locking module are separate units.

14 Claims, 6 Drawing Sheets

DEVICE FOR OPERATING A SWITCH FOR RAIL POINTS

FIELD OF THE INVENTION

The present invention relates to a device for operating and securing the switch blades in a switch of a railway track.

BACKGROUND OF THE INVENTION

When operating a switch of a railway track, a switch operating mechanism is required to move two, usually interconnected, switch blades from a first end position, to a second end position. In the first end position, one switch blade makes contact with the inside of one of the rails of a railway track. In the second end position, the other switch blade makes contact with the inside of the other rail of a railway track. The prior art usually discloses a switch operating mechanism that is located on one side of the track. From this mechanism, the switch blades are influenced in an indirect manner with the aid of connecting rods that pass under the nearest support rail in the railway track and under the nearest switch blade. The connecting rod is then connected to the link, which interconnects the two switch blades. Further, control rods are utilized for indication of switch blade positions. These rods and links are exposed to the surroundings, which means that such equipment is relatively unprotected against the effect of environmental factors such as snow, ice and dirt. The equipment comprising rods and links is usually located between sleepers for supporting rails in a railway track and, thus, constitutes an obstacle to mechanical track maintenance, since such equipment cannot withstand the stresses from such maintenance work.

Swedish patent application SE 396425 (corresponding to U.S. Pat. No. 4,093,163) discloses a proposal for solving the above-mentioned problems. The cited document suggests a method for solving the problems by arranging the switch operating mechanism in a box girder of approximately the same dimensions as those of an ordinary sleeper to support track rails. The box girder, with the switch operating mechanism housed therein, can be arranged symmetrically in the pattern of juxtaposed, equidistantly spaced sleepers that serve as a base for the rails of a railway track. At the same time, the box girder provides protection against external environmental influence for all the equipment enclosed in the box girder. In this respect, the switch operating mechanism constitutes no obstacle to the use of mechanical equipment for track maintenance at switches with one or more switch machines. However, the switch machine according to the cited document has never been commercially exploited, and this for several reasons, some of which will be described in the following.

Current demands for rapid transports have resulted in extensions and improvements of railway tracks to permit higher speeds of vehicles on these tracks. Today, speeds of between 200 and 300 km/h are not unusual for high-speed trains. Increased speeds are aimed at for tramway and underground vehicles.

The safety requirements have always been very stringent for railbound traffic. One component in the railbound communication networks that is especially sensitive to faults are the switches that of necessity, are included in all track systems. Switches that, for various reasons, are incorrectly set are responsible for a large proportion of the accidents that occur in railbound traffic. Modern switches must fulfill high safety requirements. The solution to a switch described in the above publication does not fulfill these high requirements. One of the major weaknesses is that the switch machine according to the above prior art does not lock the switch in the different switch blade positions from the safety point of view. No separated locking function exists. In addition, with the simple locking, which is vaguely mentioned in the cited publication, the operating mechanism of the switch machine itself is subjected to the very great forces to which the locking can be subjected. Nor is there any possibility of detecting whether the switch is locked in one or the other end position. Another drawback is that the known switch machine is not adapted to permit rail displacement, that is, the phenomenon which results in extension or shortening of the rails. Rail displacement, which entails mutual displacements between the switch blades and the adjacent support rail in the switch, must be acceptable.

In addition, the known switch machine does not have the possibility of adapting to different strokes for operating switch blades the desired distances in the longitudinal direction of the switch machine, that is, across the track. This is a requirement if the same switch machine is to be able to be used in switches for operation by high-speed vehicles. Such switches can be very long since a large curve radius is required for the high-speed vehicles, whereby 5–6 switch machines in a row along the track may be required for operating one single switch, since the switch blades can be very long. The strokes of the switch machines located along the switch may be capable of being adapted to the requirement of the respective switch blade for lateral displacement at the respective location of the switch machines.

One further disadvantage with the known switch are the service problems. Since all equipment is housed in the above-mentioned box girder, the accessibility is reduced since the box girder must be opened for replacement of units.

SUMMARY OF THE INVENTION

The present invention relates to a device for operating at least one switch blade in a switch for rail points from a first position to a second position in a movement across the longitudinal direction of the track. The device includes an operating mechanism and a locking function that secure the positions of the switch blades either to or from their first or second end position. The device further includes a mechanism for indicating/recording (checking) in which of the first or second position the switch blades are situated in the switch. At least the basic functions operating mechanism and locking function are housed in a box girder designed in the form of a sleeper. The box girder is intended to replace an ordinary sleeper for supporting the rail track when placing the switch operating device in a switch. The operating mechanism and the locking function comprise modules including, at least a motor operating unit, a linear operating unit and at least one locking module. Each module constitutes separate units and each separately constitutes modules that are accessible and replaceable from the outside of the box girder.

All of the above-mentioned mechanism and functions are housed and enclosed in one and the same box girder having substantially the same dimensions as a normal sleeper in the railway track. The advantage of this design is that no problems or obstacles whatsoever will arise during automatic track maintenance on a railway embankment for the track. A rational management of the track maintenance is obtained.

In the following, the device according to the invention is referred to by the comprehensive term switch machine.

Another advantage of the above-mentioned arrangement of the mechanisms of the device in a box girder is that all mechanical and associated equipment is protected against external environmental influence in the form of snow, ice, dirt, or other obstacles.

A further important advantage of the construction of the device with the equipment built into a box girder is that the different units in the device are modularized, which means that the different functional units included in the switch machine such as motor operating unit, locking module, among others, can be replaced relatively easily and rapidly for corrective action or maintenance work. All the functional units can be replaced without the rail-supporting sleeper in the form of a box girder, included in the switch machine, having to be upset in its track installation. This means that the function of the sleeper steel box (box girder) as a supporter of the rail track is independent—from the point of view of installation—of the functional units built into the switch machine for operating the switch.

The device comprises a mechanical solution of the locking function for securing the positions of the switch blades in a failsafe manner in a first or a second position. The locking function comprises two mutually independent locking modules, each of which secures the specified positions of the switch blades. Further, the invention comprises a function sequence between the two locking modules that permits one of the locking modules to be operative. The other locking module functions in a passive, or standby manner. In the event of a fault in the operative locking module, the other locking module is immediately mechanically activated. An additional advantage is that the locking device influences the locking of the switch blade directly via a lid on the box girder in which the locking device is enclosed and, in addition, has a satisfactorily enclosed design in the sleeper-replacing box girder with respect to the external severe environmental conditions in the track.

Furthermore, the invention comprises the feature that the switch operating mechanism has a design that permits adjustment of the stroke, that is, the lateral movement of the switch blade across the track at the current point of engagement of the switch machine with the switch blade. The stroke can be changed in a reliable manner according to the needs of the switch. This embodiment entails a considerable advantage in that only one design of the switch machine covers all the needs of strokes existing on the market.

In addition, the invention comprises a detection function in the locking mechanism that directly indicates and records the secure locking of the switch blade between the active locking components in the locking mechanism.

In addition to the above, the invention comprises a detection mechanism that makes possible indication of the position of the switch blade in relation to its support rail in the first and second positions, respectively. This detection mechanism is not influenced by rail displacement, maintenance factors, or by environmental conditions as those exemplified above.

The device further comprises a mechanism that achieves a static stalling thrust between the switch blade and the support rail when the switch blade is in its end position against the support rail. The advantage of this is that the point of the switch blade always makes contact with its support rail in spite of wear or bending of the support rail caused by poor track maintenance.

The switch machine according to the invention is designed in a trailable as well as a non-trailable version. A non-trailable switch is a switch in which both switch blades are locked in their end positions. A trailable switch, on the other hand, is a switch in which the end position of a switch blade close to the support rail is locked, whereas the end position of a switch blade away from the support rail is not locked and can be trailed with a definite force, which affects the blade.

The concept switch blade, as used in the description, also includes the movable frog that exists in a switch. In modern switches it may also be desirable also to operate the movable frog when operating the switch.

FIG. **4*b*** show the locking function with two locking modules according to the present invention in a view across the switch machine.

FIG. **4*a*** shows a side view of a locking module in a non-trailable embodiment in the longitudinal direction of the switch machine of the present invention.

FIG. **4*c*** shows a side view of the locking module in a trailable embodiment in the longitudinal direction of the switch machine of the present invention.

Figure 5:
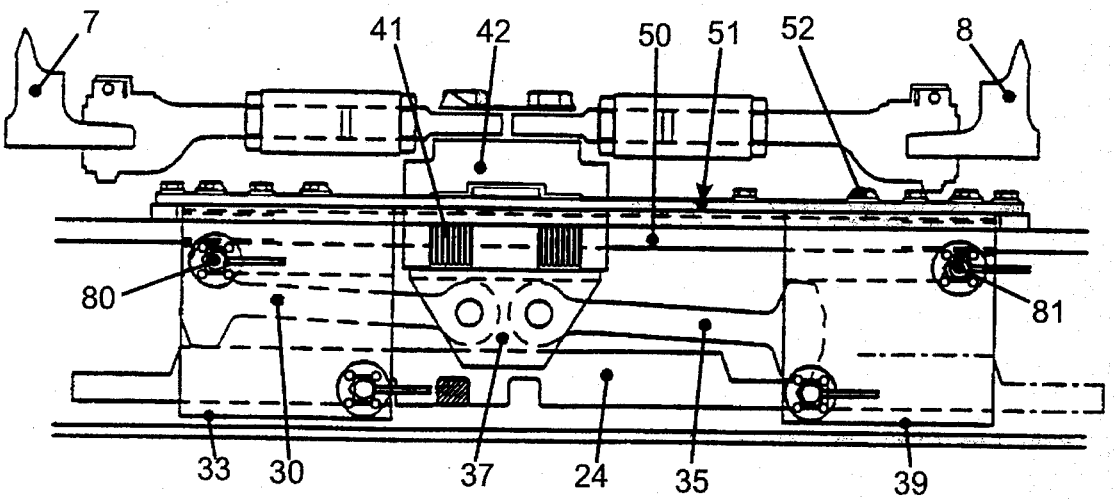

FIG. 5 illustrates the locking module with detecting detectors indicated therein.

Figure 6A:
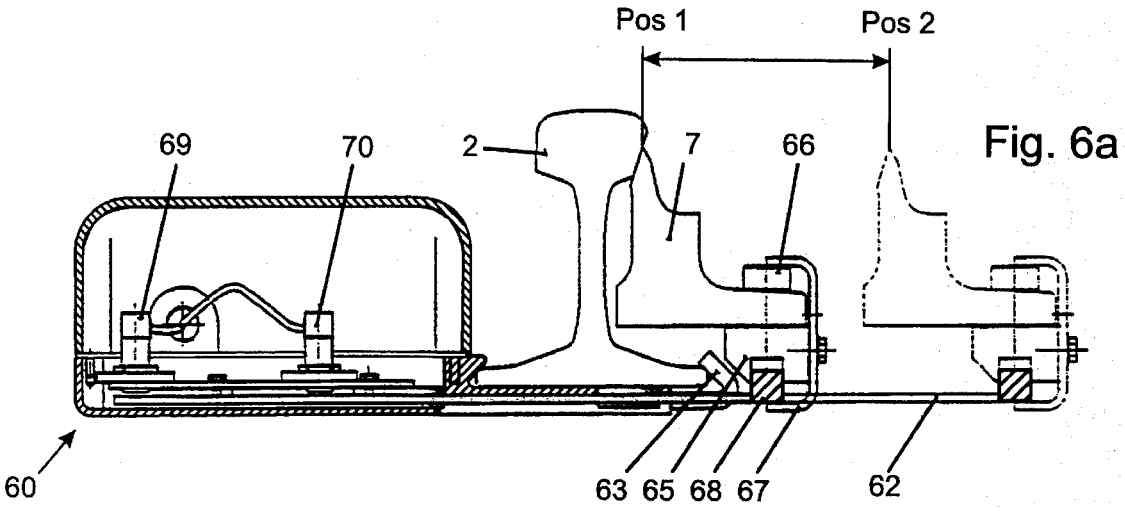
Figure 6B:
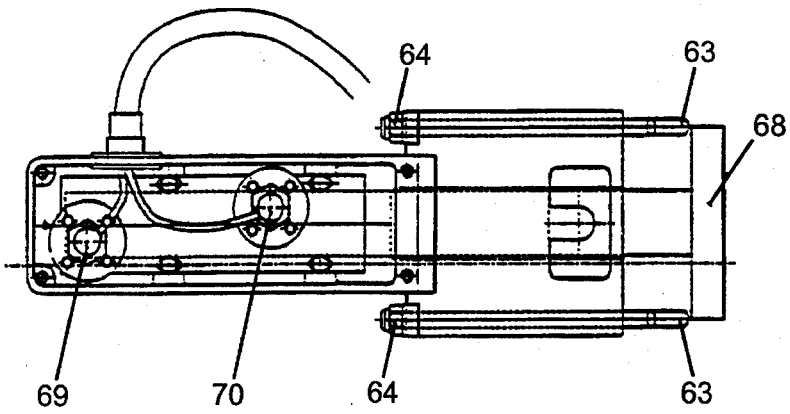

FIG. **6*a* and FIG. 6*b*** show the location of a detector means for detecting the actual position of the switch blade, partly in a vertical section through such a detector means, partly in a plan view.

Figures 7A, 7B:
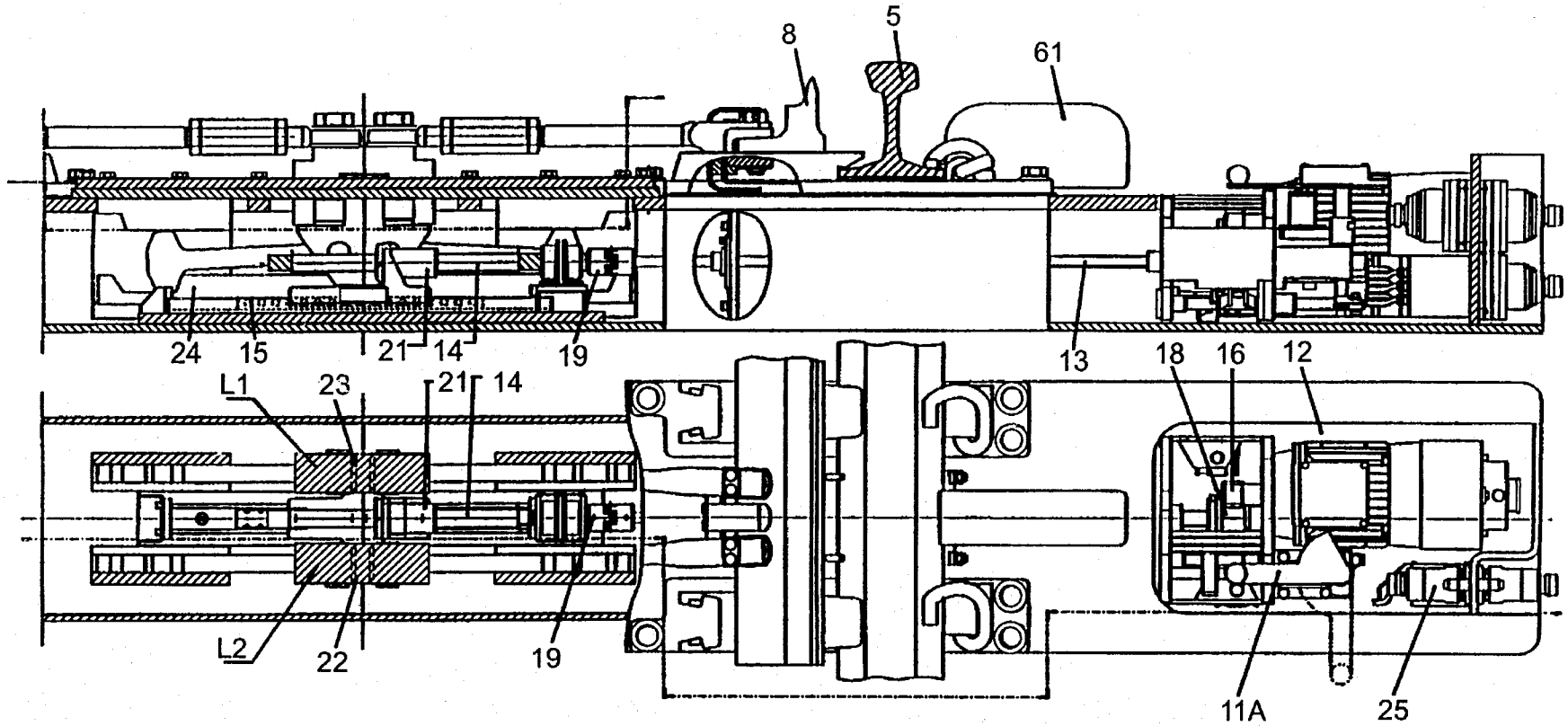

FIG. **7*a* and FIG. 7*b*** are a side view and a plan view, respectively, from above of the equipment in the switch machine housed in its box girder.

Figure 8:
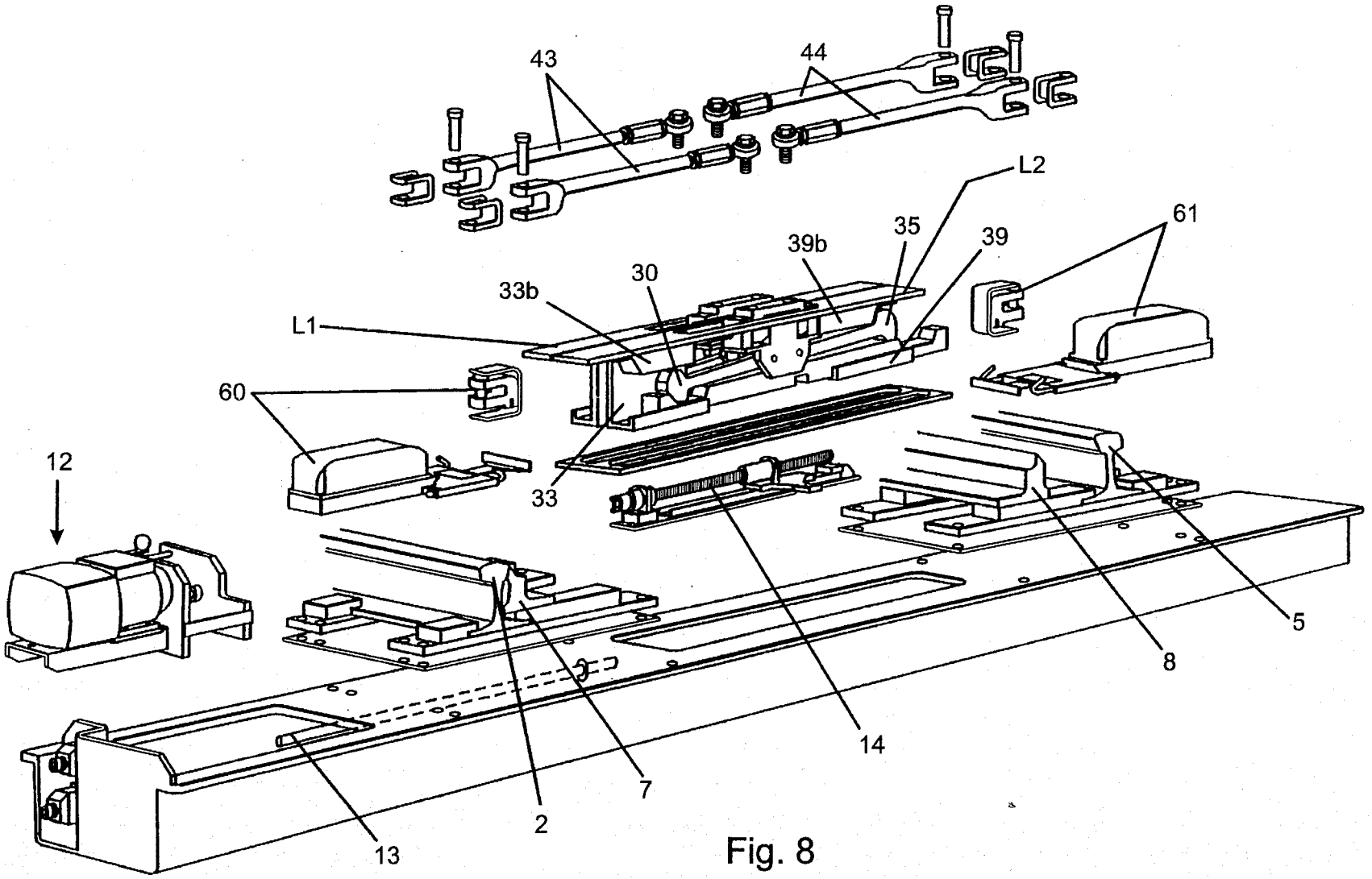

FIG. 8 is a perspective view of units for the switch machine according to the invention.

DETAILED DESCRIPTION OF THE PREFERRED EMBODIMENTS OF THE PRESENT INVENTION

Figure 1:
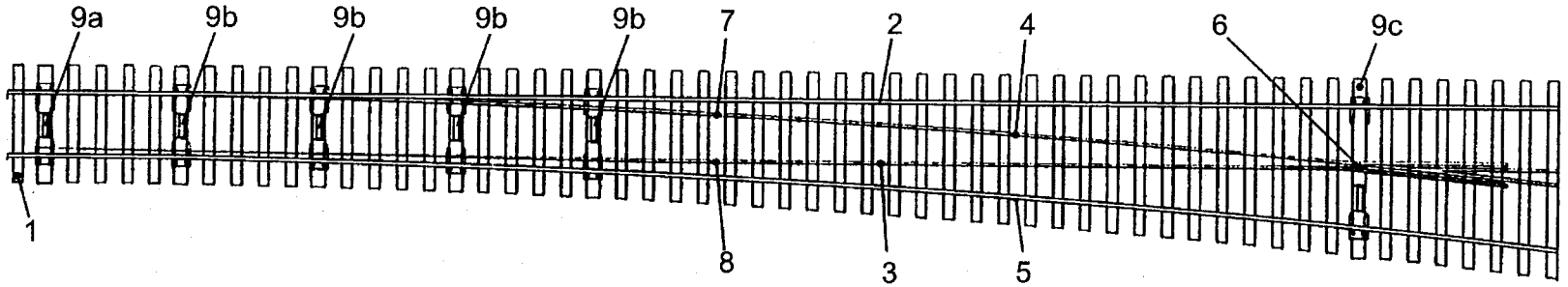
FIG. 1 is a plan view, from above, of a modern switch, wherein a number of switch machines for operating switch blades and a movable frog are installed.

In a switch according to FIG. 1, sleepers 1 for supporting the rails 2 and 3 of a railway track and the rails 4 and 5 associated with a branch track are illustrated. Switch machines **9*a*–9*c* are located along the switch in a necessary number. In switches included in a track over which high-speed travel, the length of the switch may be considerable. For example, as shown in the example in FIG. 1, six switch machines may be required. At the very branch point 6 in the switch, there extend to the left in the figure switch blades forming rails 7 and 8. These rails 7, 8 are interconnected at the respective switching point (the position of the switch machine 9*a*–9*c*) and can be shifted to different end positions constituting the first and second position, respectively, of the switch blade at the switching point. One of the switch machines according to FIG. 1 consists of a blade point-type switch machine 9*a*, which serves as a master unit, whereas the other switch machines along the switch blade serve as slave switch machines 9*b*. At the movable frog, a movable frog-type switch machine 9*c*** is located.

Figure 2:
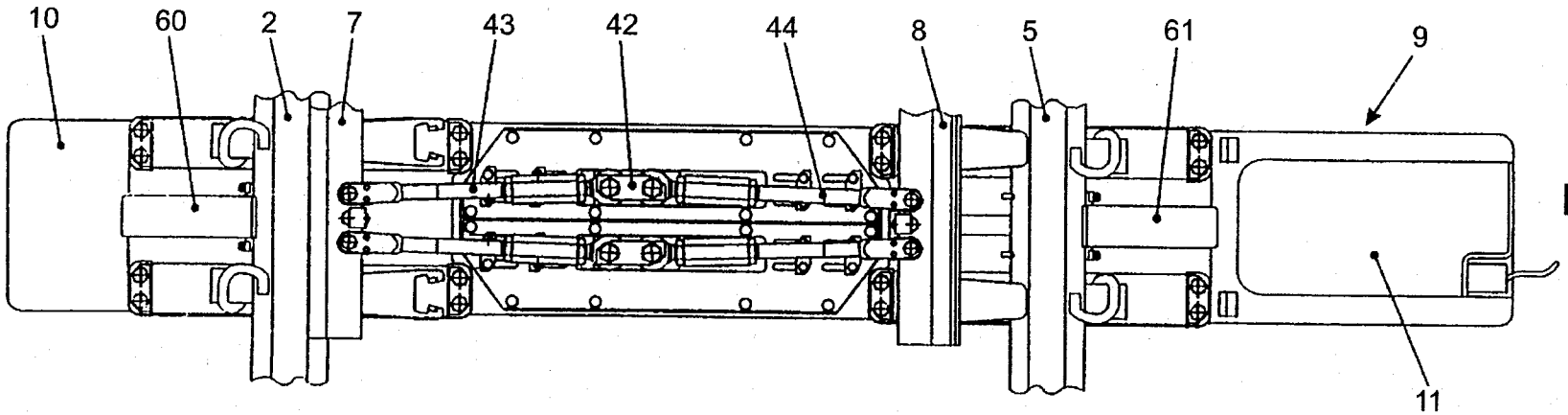
FIG. 2 is a plan view from above of an embodiment of a switch machine according to the present invention.
Figure 3:
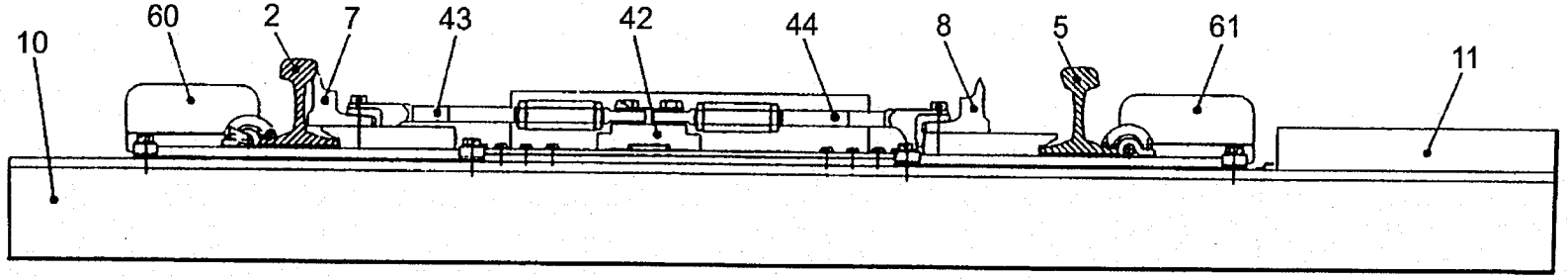
FIG. 3 is a vertical cross section through the railway track and a side view of the box girder that houses the mechanisms of the switch machine according to the present invention.

The switch machine is shown in its entirety in a view from above in FIG. 2 and in a longitudinal view from the side in FIG. 3. A lid 11 over the motor operating unit is shown to the right in FIGS. 2 and 3.

The operation of the movable units by means of the operating mechanism is illustrated in FIG. 7*a* and FIG. 7*b*. These figures show vertical section along the box girder 10 and a partially sectioned plan view. These figures illustrate, from the righthand end of the box girder 10, the motor operating unit 12, a transmission shaft 13, a ball screw 14 (which constitutes a linear operating unit), and a linear ball bearing 15 in the center line at the bottom of the box girder 10.

Upon start-up, the motor of the operating unit 12 rotates in a clockwise or counterclockwise direction, depending on which control has been given. A motor pinion 16 drives a gear ring on the slipping (or friction) clutch 18 that, in turn, drives the transmission shaft 13. The transmission shaft 13 transmits the rotation via an elastic coupling 19 to a ball screw 14, which causes a ball nut 21 into a linear motion in the longitudinal direction of the switch machine. The ball nut 21 is guided in the linear ball bearing 15, which is mounted at the bottom of the box girder 10. On either side of the ball nut 21, two carrier pins 22, 23 are mounted, each of which separately transmits the motion of the ball nut 21 to a drive rod 24 associated with each locking module L1, L2. These locking modules L1, L2 and their locking function will be described below.

For manual operation of the switch machine, a switching device is provided that disengages the motor and connects the gear ring of the friction clutch 18 to a hand-operated switch. Changeover to manual operation is achieved by pressing down a lever 11*a* and turning it 90° around its axis. When the changeover has been carried out, a crank for manual operation of the switch machine is connected to a switch pin for manual operation of the transmission shaft 13. The switch pin is disengaged while, at the same time, the lever 11*a* assumes the new position. The motor and the sensors mounted in the switch machine are electrically connected to an external central unit by way of two separate contacts 25, which are mounted in the end wall of the box girder 10.

The type of motor in the operating unit 12 can be chosen freely but consists in the above described embodiment of a three-phase asynchronous motor. The supply of the motor according to the example is controlled from an external control unit at the switch. The control unit receives continuous information about and evaluates the state of the sensors in the entire switch operating system.

Since at the same switch a plurality of switch machines with varying strokes must cooperate synchronously when operating the switch, the individual motors at the respective switch machine are supplied with different voltages by frequency converter equipment that can control the motor to a speed of rotation adapted to the stroke of the respective switch machine.

Because of the signals of the sensors to the control unit, the motors in the individual switch machines can be controlled individually. This means that the described motor control function permits:

synchronous running in an operating system for the entire switch, that is, the same operating time for all the switch machines included, a controlled and even current consumption, the same torque during the whole operation cycle, and speed control during the operation cycle.

The locking and the operation at a switch machine will be described in the following with reference to FIGS 4*a*–*c*. As is clear from FIG. 4*a*, the drive rod 24 in a locking module L2 is influenced by the carrier pin 22. Upon movement of the carrier pin 22 during a switch operation, the drive bar 24 is brought along in the same movement.

Figure 4A:
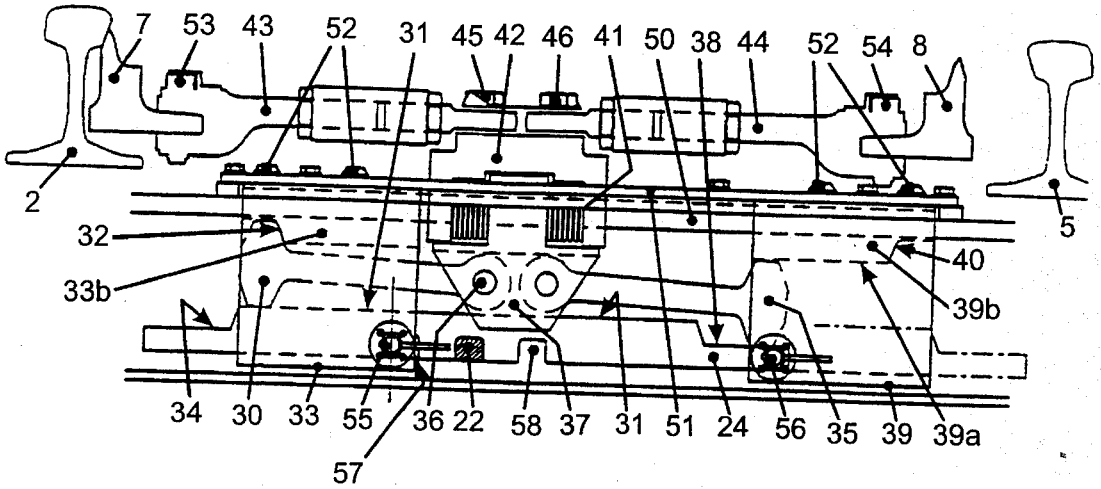

In case of an operation of the switch in which in FIG. 4*a* the switch blades 7, 8 are to be shifted from a first position shown in FIG. 4*a* to a second position where the switch blades 7, 8 have swung to the right in FIG. 4*a*, the operation is started by moving the drive bar 24 about 50 mm to the right. Up to this point $t_1$, the position of the switch blades 7, 8 is secured in the first position by a lefthand lock catch 30. The lefthand lock catch rests on the upper sliding surface 31 of the drive bar 24 and secures the lock catch 30 in a raised position in a first locking slot 32 at the end of a first locking shoulder 33*b* arranged in a first locking block 33. The lefthand lock catch 30 thus prevents the associated switch operating parts from being displaced to the right as shown in FIG. 4*a*, where the switch blades 7, 8 cannot be moved to the right. When the drive bar 24 at time $t_2$ permits the lefthand lock catch 30 to fall down into the lefthand unlocking slot 34 of the drive bar 24, unlocking from the first position of the switch has taken place.

Upon continued movement to the right, as shown in FIG. 4*a*, the drive bar 24 will, with the righthand lock catch 35 as carrier, via its shaft journal 36, move the lower center block 37 to the right. The righthand lock catch 35 cannot be lifted from the righthand unlocking slot 38, since the uppermost surface of the lock catch slides under the lower sliding surface 39*a* of a second shoulder 39*b*, arranged in a second locking block 39. The upper center block 42 is urged to accompany the lower center block 37 in its movement to the right. When the upper center block 42 moves to the right, the switch blade connection rods 43, 44 are influenced by the connections thereof to the upper center block 42'. These connections are rotatable around the pins 45, 46. The connection rods 43, 44 move the switch blades 7, 8 to their new end positions, that is, the second switch position for the respective switch blade.

When the switch blades 7, 8 at time $t_3$ have reached their second positions, the righthand lock catch 35 has at the same time arrived at a second locking slot 40 in the second shoulder 39*b*, whereby the righthand lock catch 35 has been displaced upwardly in this second locking slot and starts sliding on the upper sliding surface 31 of the drive bar 24. This causes the righthand lock catch 35 to lose its carrier function for the lower center block 37 and the other switch operating parts. At the same time, the righthand lock catch 35, raised in the second locking slot 40, secures this second switch position in that the righthand lock catch 35 cannot be moved to the left as long as the upper sliding surface 31 of the drive bar 24 supports the righthand lock catch in its raised, locked position in the second locking slot 40. Consequently, the switch is locked in the second switch position.

The locking is secured according to the above by the drive bar 24 continuing its movement about 50 mm to the right, as shown in FIG. 4*a* after time $t_3$.

FIG. 4*a* shows the locking mechanism in the longitudinal direction of the box girder 10. FIG. 4*b* illustrates, in a cross-sectional view, two locking modules L1 and L2 operating independently of, and parallel to, each other. By allowing one of the locking modules to act somewhat later than the other, one actively-operating and one passively-operating locking mechanism are obtained. The description also shows that the locking mechanisms function independently of the operating mechanism. This means that external forces, which for some reason influence a switch blade 7, 8 in the switch machine, are conveyed to the locking mechanism and, hence, not supplied to the operating mechanism.

The locking modules (L1, L2) are designed in a non-trailable version, as shown in FIG. 4*a*. In a non-trailable version, a lower center block (37) via an upper center block (42), which transmits operation forces to switch blade connection rods (43, 44) are each designed in one piece. Hence, the upper and lower center blocks influence both switch blade (7, 8) simultaneously.

Figure 4C:
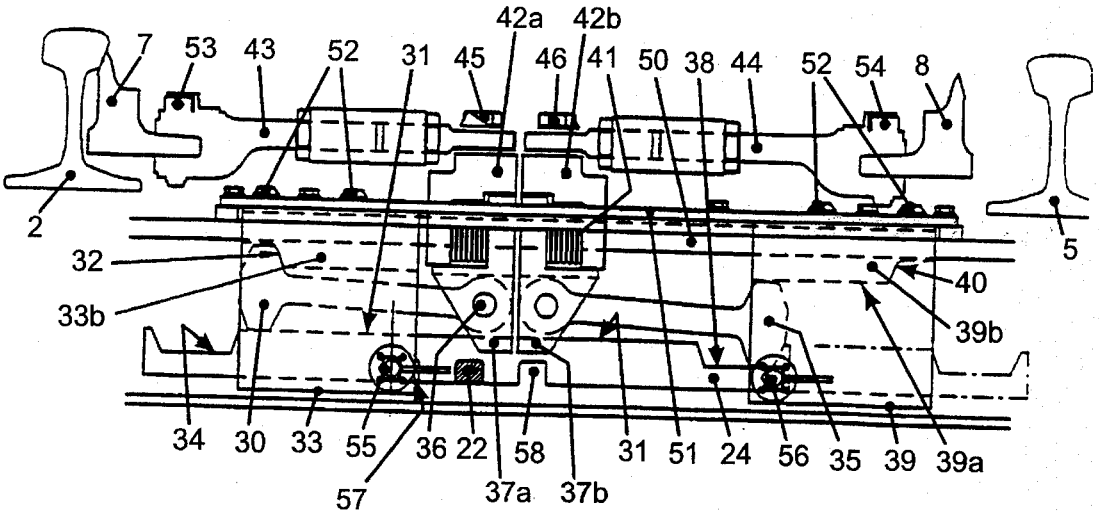

The locking modules L1 and L2 are also designed in a different embodiment, as shown in FIG. 4*c*. In the non-trailable version, both the lower center block (37) and the upper center block (42) are designed in two halves, lower center block halves (37*a*, 37*b*) and upper center block halves (42*a*, 42*b*). In the non-trailable version, the switch blade connection rods (43, 44) are influenced by the lower center block half (37*a*, 37*b*) and the upper center block half (42*a*, 42*b*) belonging to the respective connection rod (43, 44).

The adaptation of the stroke of the switch machine is achieved by displaceably mounting the lower center block 37 and the upper center block 42 connected thereto along a shaft 50, as shown in FIG. 5. The shaft 50 in its turn is threaded with its lefthand end by means of a lefthand thread into the first locking block 33. The shaft 50 also is threaded with its righthand end by means of a righthand thread into the second locking block 39.

The first and second locking blocks 33 and 39, respectively, are displaceably screwed to a cover plate 51, secured to the box girder, by means of the screw joint 52. By loosening the joint 52, the locking blocks 33 and 39, respectively, can be moved towards or away from each other. This means that the distance between the above-described two locking positions of the switch machine is changed, since the two locking slots 32, 40 are moved closer to or further away from each other. The two lock catches 30, 35 transmit the operation movement from the drive 24 to the lower center block 37 and the other switch operating parts. As mentioned, the locking slots 32, 40 also have the function of interrupting this carrier movement. The stroke of the switch machine is thus changed when the locking slots 32 and 40 are moved closer to or further away from each other.

Rail displacement occurs in the switch, which means that a support rail 2, 5 in the railway track can be displaced in the longitudinal direction in relation to an adjacent switch blade 7, 8, for example due to movements caused by the linear expansion of the rails. For this reason, the switch blade connection rods 43, 44 are rotatably connected to the center block 42 and to the switch blade 7, 8, as shown in FIG. 2. The rotatable connection is designed such that the connection rods are able to turn around pins 45, 46 in the center block 42 and around pins 53, 54 at the switch blades 7, 8, respectively. A space free from obstacles for the connections of the connection rods 43, 44 to the rails of the switch blades permits a relative displacement that, in the example, amounts to ±40 mm in the longitudinal direction of the track between the switch blades 7, 8 and the respective support rails 2, 5 thereof, the latter being fixed to the box girder (10).

Figure 4B:
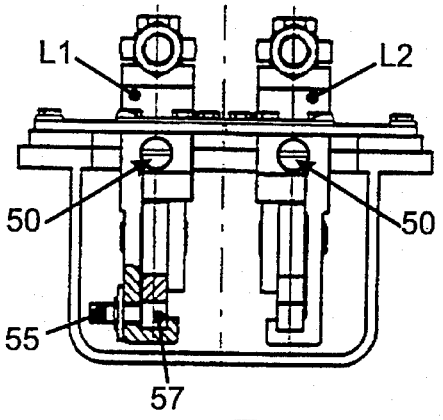

Means for detecting the locking function are clear from, among other things, FIGS. 4*a–c* and 5. FIGS. 4*a–c* show sensors 55, 56 that are mounted on the locking blocks 33, 39. Further, the drive bar 24 is provided with two recesses 57, 58, that are placed such that their respective position in a locked first and a locked second position open an air gap in front of the respective sensor 55, 56 when the respective sensor is to indicate an adopted locking position.

During its movement in all other positions of the switch blade, the drive bar 24 covers the sensors 55, 56, whereby these indicate metal, that is, locking positions not reached. Since it is the locking blocks that are moved towards or away from each other when setting the stroke of the switch machine, the locking position indication will always assume the correct position for each conceivable setting of the stroke, without necessitating any readjustment whatsoever of the inductive sensors 55, 56 for locking position indication. This function is achieved by mounting the sensors 55, 56 at specified locations on the locking blocks 33, 39 and by providing defined positions for the recesses 57, 58 on the drive bar 24.

To make the detection function thoroughly failsafe, the sensors 55, 56 are provided with a self-test function that uninterruptedly tests the ability of the sensor to detect. The type of sensor described can, of course, be replaced by other types of sensors, for example, mechanical ones. The detection function described detects that the lock catches 30 and 35, respectively, independently of the setting of the stroke, are secured in the locking blocks 33 and 39, respectively, by sensing that the determined locking distance (50 mm) of the drive bar 24 has been reached.

Means for detecting the position of a switch blade 7, 8 relative to the support rail 2, 5 will be described with reference to FIGS. 2, 3, 6*a* and 6*b*. These Figures show two detector units 60, 61 that are each mounted on a foot of the respective support rail 2, 5 and over the sleeper box 10. These Figures show that the detection rod 62 arranged at the detector unit 60, 61 is connected to the switch blade 7, 8 supervised by the detector unit 60, 61.

The detector unit 60, 61 is connected. to the rail foot by means of two hooks 63, which can be tightened with nuts 64. The detection rod 62 is connected to the switch blade 7, 8 via a connection piece 65. The connection piece 65 is secured to the switch blade 7, 8 by means of a bolt 66 and a shackle 67. Further, the detection rod is provided with a carrier piece 68 that engages in a corresponding recess in the connection piece 65. This means that the connection piece 65 and the carrier piece 68 may slide mutually relative to each other in the longitudinal direction of the track if the support rail 2, 5 and the switch blade 7, 8 are displaced relative to each other due to rail displacement.

When the switch blade 7 is in the position according to FIGS. 6*a* and 6*b*, that is, in an end position, this is indicated by a first sensor 69 in such a way that the length of the detection rod 62 is so adapted that its lefthand end influences the field of detection of the first sensor 69 with its metal and causes the first sensor to indicate contact between the switch blade 7 and the support rail 2. If the detection rod 62 is set in motion to the right according to FIGS. 6*a* and 6*b*, because of an operation of the switch or any other impermissible movement, wherein the detection rod 62 is caused by an oscillation of the switch blade 7 to move away from the support rail 2, then, after a definite movement tolerance the first sensor 62 will indicate "non-contact" of the switch blade 7. During continued movement of the switch blade 7 and the detection rod 62 to the right in FIG. 6, the switch blade will after a certain time ($t_3$) assume position 2 (Pos 2) according to FIG. 6 (the second end position). The field of detection of a second sensor 70 has, up to time $t_3$, been under the influence of the metal of the detection rod 62. However, at time t3, detection rod 62 has moved to the right as shown in FIG. 6*a*. Sensor 70 will now detect an absence of metal since the length of the detection rod 62 in relation to the second sensor 70 is so adapted that the field of detection of the sensor no longer is influenced by the detection rod 62. Thus, sensor 70 indicates the position of an open switch blade, that is, the second end position of the switch blade 7.

Also, the above first and second sensors 69 and 70, respectively, are equipped with a self-test function as described above and can, of course, be replaced by other types of sensors.

The detection function described above detects in a direct and secure manner, independently of rail displacement and rail maintenance, the two end positions of the switch blade 7, 8, that is, Pos 1 and Pos 2 according to FIG. 6*a*.

An additional detection function of the position and locking of the switch blade 7, 8 is illustrated in FIG. 5. FIG. 5 shows two inductive sensors 80 and 81, respectively, mounted on the locking blocks 33 and 39, respectively. According to FIG. 5, the lefthand lock catch 30 is in locked position against the locking shoulder 33*b*. The sensor 80 is placed so as to detect the engagement of the lefthand lock catch 30 with the first locking slot 32 in the first shoulder 33*b*. In a corresponding manner, the sensor 81 has been mounted in a position in the second locking block 39 such that the engagement of the righthand lock catch 35 with the second locking slot 40 can be detected. According to the example shown in FIG. 5, the righthand sensor in the figure, sensor 81, does not detect the presence of the righthand lock catch 35 in locked position. Since the lefthand lock catch 30 in locked position also provides direct information that the switch blade 7, 8 is in its first end position, this first end position of the switch blade can consequently also be detected by the sensor 80. Before the switch operation movement starts, the detection of the assumed first end position of the switch blade 7, 8 by the sensor 80 will, thus, be interrupted as soon as the lefthand lock catch 35 falls out of its locked position in the first locking slot 32, after the drive bar 24 at time $t_2$ has moved the whole locking distance of the first lock catch 30. When the operation of the switch has been completed, the switch blade 7, 8 will assume its second end position. The drive bar 24 presses the righthand lock catch 35 up into its locked position in the locking slot 40. The sensor 81 detects the presence of the locked right-hand lock catch 35 and, hence, indirectly detects that the second end position of the switch blades 7, 8 is reached. The detection function now described thus indirectly detects the position of the switch blade 7, 8 and at the same time that the correlating lock catch 30, 35 in locked position.

We claim:

1. A device for operating a switch of a railway track, said switch including switch blades, said device comprising:

a drive module;

a linear operating module coupled to and driven by said drive module for generating a linear movement;

at least one locking module interconnected between said linear operating module and the switch blades for transferring said linear movement from said linear operating module to the switch blades, thereby moving the switch blades across a longitudinal direction of the railway track from a first position to a second position, said at least one locking module also locking the switch blades in said first position or said second position independently of said linear operating module;

a girder box forming a sleeper of the railway track for housing said drive module, said linear operating module, and said at least one locking module; and means for joining said drive module, said linear operating module, and said at least one locking module, said joining means permitting independent replacement of said drive module, said linear operating module, and said at least one locking module;

said drive module, said linear operating module, and said at least one locking module being separate units.

2. A device according to claim 1, comprising at least two locking modules being operated in sequence with a time lag between operation of each, said locking modules individually locking the switch blades in said first position or said second position.

3. A device according to claim 2, wherein one of said at least two locking modules automatically locks the switch blades in said first position or said second position if the other of said at least two locking modules is not operational.

4. A device according to claim 2, wherein said locking modules are non-trailable and each comprise a one piece lower center block, a one piece upper center block interconnected with said lower center block, and switch connection rods connected to said upper center block, said lower center block transmitting switch operation forces via said upper center block to said switch connection rods, thereby moving the switch blades simultaneously.

5. A device according to claim 2, wherein said locking modules are trailable and each comprise a two piece lower center block, a two piece upper center block interconnected with said lower center block, and switch connection rods connected to said upper center block, whereby said connection rods are moved by a lower center block piece and an upper center block piece interconnected with a respective connection rod.

6. A device according to claim 1, wherein said at least one locking module can be set for strokes of differing magnitudes of the lateral movement of the switch blade from said first to said second position.

7. A device according to claim 6, wherein said at least one locking module further comprises locking blocks, wherein the magnitude of the stroke of said at least one locking module is set by displacing said locking blocks nearer to or further away from each other.

8. A device according to claim 4, wherein said switch blade connection rods are rotatably connected to the switch blades and rotatably connected to said center block, said rotatable connections rendering the device independent of rail displacement.

9. A device according to claim 1, further comprising means for detecting whether the switch blades are in said first position or said second position.

10. A device according to claim 6, further comprising:

a drive bar interconnected with said linear operating module and said locking module, said drive bar operating independently of a stroke for the switch blades; and means for detecting that said drive bar has completed a determined operation and locking distance.

11. A device according to claim 1, wherein said locking module further comprises:

a lock catch;

a locking slot for engaging said lock catch; and means for detecting that said lock catch is in engagement with said locking slot, thereby indirectly indicating that the switch blades are locked in said first position or said second position.

12. a device according to claim 1, wherein said locking module further comprises a spring, wherein if the switch blades make contact with rails of the railway track, said locking module moves the switch blades with a determined force against said spring package, thereby pressing the switch blades against the rails with said spring force.

13. A device according to claim 9, wherein said detecting means is provided as a separately replaceable module.

14. A device according to claim 1, wherein said drive module an electrically, hydraulically or manually driven motor.

* * * * *